US010487471B2

(12) United States Patent
Booth et al.

(10) Patent No.: US 10,487,471 B2
(45) Date of Patent: Nov. 26, 2019

(54) WOVEN GEOTEXTILE FABRICS

(71) Applicant: Willacoochee Industrial Fabrics, Inc., Willacoochee, GA (US)

(72) Inventors: Eric Lee Booth, Willacoochee, GA (US); Kevin William Ray, Willacoochee, GA (US)

(73) Assignee: Willacoochee Industrial Fabrics, Inc., Willacoochee, GA (US)

( * ) Notice: Subject to any disclaimer, the term of this patent is extended or adjusted under 35 U.S.C. 154(b) by 40 days.

(21) Appl. No.: 16/034,588

(22) Filed: Jul. 13, 2018

(65) Prior Publication Data

US 2018/0320332 A1 Nov. 8, 2018

Related U.S. Application Data

(63) Continuation-in-part of application No. 14/561,858, filed on Dec. 5, 2014, now Pat. No. 10,024,022.

(60) Provisional application No. 61/914,201, filed on Dec. 10, 2013.

(51) Int. Cl.

| | |
|---|---|
| ***E02D 17/20*** | (2006.01) |
| ***D03D 13/00*** | (2006.01) |
| ***D03D 15/00*** | (2006.01) |
| ***E01C 7/32*** | (2006.01) |
| ***E02B 3/12*** | (2006.01) |
| ***E01C 3/00*** | (2006.01) |
| ***E01C 11/16*** | (2006.01) |

(52) U.S. Cl.

CPC ..... *E02D 17/202* (2013.01); *D03D 13/008* (2013.01); *D03D 15/00* (2013.01); *D03D 15/0088* (2013.01); *E01C 3/006* (2013.01); *E01C 7/325* (2013.01); *E01C 11/16* (2013.01); *D10B 2321/022* (2013.01); *D10B 2505/204* (2013.01); *E02B 3/126* (2013.01); *Y10T 442/3065* (2015.04)

(58) Field of Classification Search

None

See application file for complete search history.

(56) References Cited

U.S. PATENT DOCUMENTS

| | | | |
|---|---|---|---|
| 4,417,828 | A | 11/1983 | de Winter |
| 4,449,857 | A | 5/1984 | Davis |
| 4,502,815 | A | 3/1985 | Scales et al. |
| 4,815,499 | A | 3/1989 | Johnson |
| 5,091,247 | A | 2/1992 | Willibey et al. |
| 5,108,224 | A | 4/1992 | Cabaniss et al. |
| 5,567,087 | A | 10/1996 | Theisen |
| 5,616,399 | A | 4/1997 | Theisen |
| 5,651,641 | A | 7/1997 | Stephens et al. |
| 5,735,640 | A | 4/1998 | Meyer et al. |
| 6,179,013 | B1 | 1/2001 | Gulya |
| 6,502,360 | B2 | 1/2003 | Carr, III et al. |
| 7,112,283 | B2 | 9/2006 | Stephens |

(Continued)

OTHER PUBLICATIONS

WINFAB 400HTM Product Data Sheet; Willacoochee Industrial Fabrics, Inc., Copyright 2013; 1 page.

(Continued)

*Primary Examiner* — Shawn Mckinnon

(74) *Attorney, Agent, or Firm* — Harness, Dickey & Pierce, P.L.C.; Anthony G. Fussner

(57) ABSTRACT

Disclosed are exemplary embodiments of woven geotextile fabrics. In exemplary embodiments, a geotextile has a high water flow rate, such as a water flow rate of at least 125 gallons per minute per square foot, etc.

19 Claims, 9 Drawing Sheets

(56) References Cited

U.S. PATENT DOCUMENTS

| | | | |
|---|---|---|---|
| 7,740,420 | B2 | 6/2010 | Jones et al. |
| 7,874,767 | B2 | 1/2011 | Jones et al. |
| 8,088,117 | B2 | 1/2012 | Stephens et al. |
| 8,252,705 | B2 | 8/2012 | King et al. |
| 8,333,220 | B2 | 12/2012 | King |
| 8,598,054 | B2 | 12/2013 | King et al. |
| 2008/0207073 | A1 | 8/2008 | Jones |
| 2009/0208288 | A1 | 8/2009 | Stephens et al. |
| 2011/0206458 | A1 | 8/2011 | Jones et al. |
| 2011/0250448 | A1 | 10/2011 | Jones et al. |
| 2012/0052759 | A1 | 3/2012 | Wang |
| 2013/0044623 | A1 | 2/2013 | Speight et al. |
| 2013/0244521 | A1 | 9/2013 | Jones et al. |
| 2014/0099850 | A1 | 4/2014 | King et al. |
| 2014/0241817 | A1 | 8/2014 | Jones et al. |

OTHER PUBLICATIONS

WINFAB 600HTM Product Data Sheet; Willacoochee Industrial Fabrics, Inc., Copyright 2013; 1 page.

WINFAB 650HTM Product Data Sheet; Willacoochee Industrial Fabrics, Inc., Copyright 2013; 1 page.

WINFAB 450HTM Product Data Sheet; Willacoochee Industrial Fabrics, Inc.; Copyright 2013; 1 page.

WINFAB 300HTM Product Data Sheet; Willacoochee Industrial Fabrics, Inc.; Copyright 2013; 1 page.

Canadian Office Action dated Dec. 16, 2015 issued in Canadian Application No. 2,873,824 filed Dec. 9, 2014 which claims priority to the parent application to the instant application, 3 pages.

Canadian Office Action dated Jun. 7, 2016 issued in Canadian Application No. 2,873,824 filed Dec. 9, 2014 which claims priority to the parent application to the instant application, 4 pages.

WOVEN GEOTEXTILE FABRICS

CROSS-REFERENCE TO RELATED APPLICATIONS

This application is a U.S. continuation-in-part of U.S. non-provisional patent application Ser. No. 14/561,858 filed Dec. 5, 2014 (issuing Jul. 17, 2018 as U.S. patent Ser. No. 10/024,022), which, in turn, claims the benefit of and priority to U.S. provisional patent application No. 61/914,201 filed Dec. 10, 2013. The disclosures of the applications identified in this paragraph are incorporated herein by reference in their entirety.

FIELD

The present disclosure relates to woven geotextile fabrics.

BACKGROUND

This section provides background information related to the present disclosure which is not necessarily prior art.

Geotextile fabrics are permeable fabrics that may be used in association with soil, for example, for soil reinforcement, retention, stabilization, etc. Three basic types of geotextile fabrics include woven, needle punched, and heat bonded. A woven geotextile fabric may include warp and weft yarns interwoven together with the warp yarns inserted over-and-under the weft yarns (or vice versa) to thereby secure the yarns together.

SUMMARY

This section provides a general summary of the disclosure, and is not a comprehensive disclosure of its full scope or all of its features.

Disclosed are exemplary embodiments of woven geotextile fabrics. In exemplary embodiments, a geotextile has a high water flow rate, such as a water flow rate of at least 125 gallons per minute per square foot, etc.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

Corresponding reference numerals indicate corresponding parts throughout the several views of the drawings.

DETAILED DESCRIPTION

Figure 1:
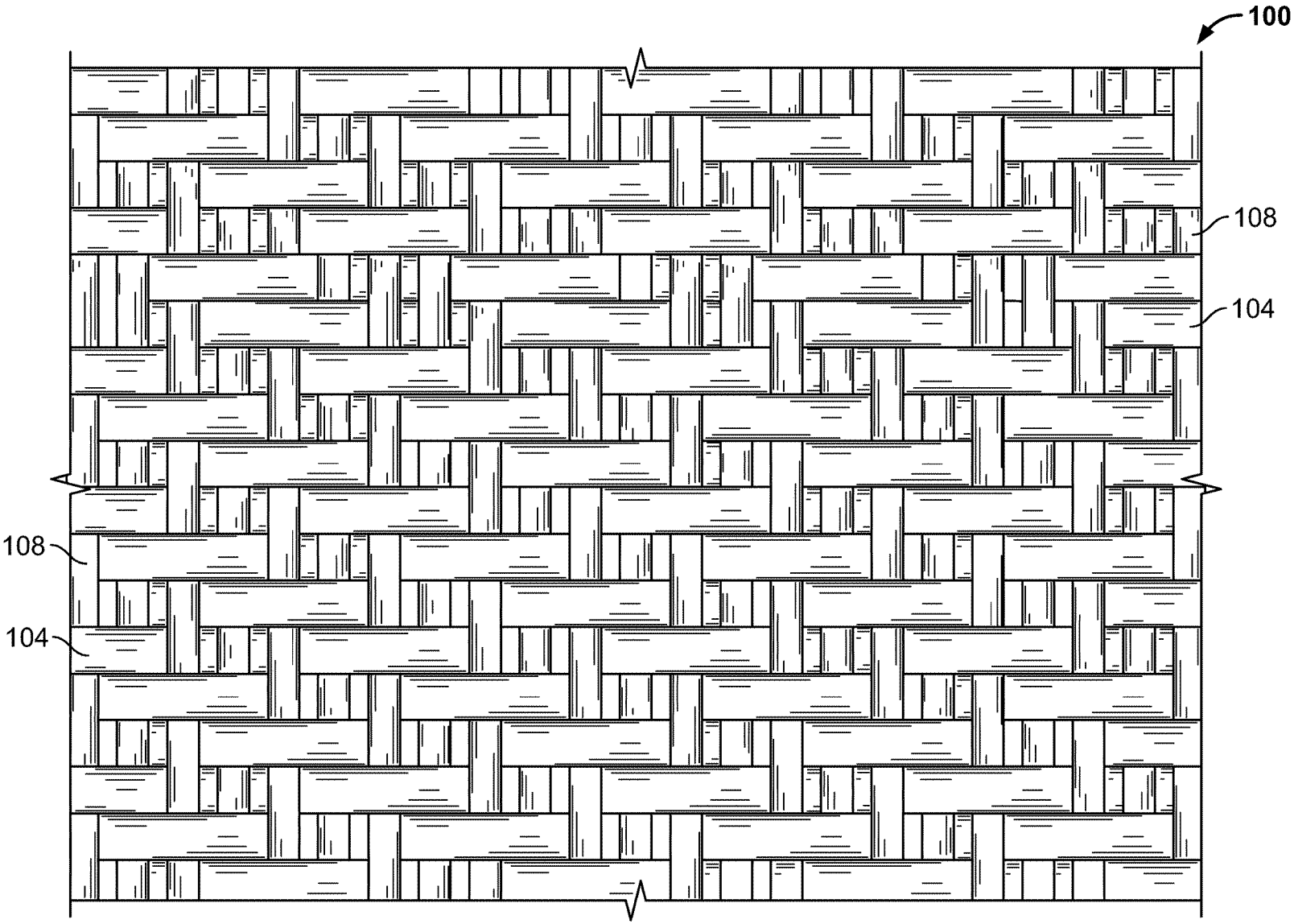
FIG. 1 is a top view of a woven geotextile fabric having a 3/3 twill weave according to an exemplary embodiment.

Example embodiments will now be described more fully with reference to the accompanying drawings.

Disclosed herein are exemplary embodiments of woven geotextile fabrics that may be used in various applications. In exemplary embodiments, a woven geotextile fabric may be configured to allow water to pass through the fabric at a high rate, such as a water flow rate of at least 125 gallons per minute per square foot (gpm/ft$^2$), within a range from 125 gpm/ft$^2$ to 300 gpm/ft$^2$, etc.

The woven geotextile fabric may include one or more different types of yarn having different cross-sectional shapes or geometries. The fabric may be formed by layers of warp and weft yarns secured or interwoven together in a weave, construction, or pattern, which helps to enhance water flow and strength characteristics. By way of example, a woven geotextile fabric may have a twill weave (e.g., 3/3 twill weave, 2/2 twill weave, etc.), a basket weave (e.g., 2/2 basket weave, 2/1 basket weave, 3/1 basket weave, 3/3 basket weave, 4/4 basket weave, etc.), a sateen weave, or a plain weave. For example, warp yarns may be interwoven with and substantially perpendicular to the weft yarns such that the warp yarns cross over and then under four weft yarns. Or, for example, warp yarns may be interwoven with and substantially perpendicular to the weft yarns such that the warp yarns cross over and then under three weft yarns. By way of further example, a woven geotextile fabric may have warp yarns that are interwoven with and substantially perpendicular to the weft yarns such that the warp yarns cross over and then under two weft yarns. As yet another example, a woven geotextile fabric may have warp yarns that are interwoven with and substantially perpendicular to the weft yarns such that the warp yarns cross over and then under one weft yarns. The warp and weft yarn systems may comprise one, two, three or more different types of yarns, e.g., yarn types with different cross-sectional shapes or geometries, monofilaments, tape yarns, fibrillated tapes, etc.

In exemplary embodiments of a woven geotextile fabric, the warp and weft systems comprise monofilament (e.g., polypropylene monofilament, polyester monofilament, polyethylene monofilament, nylon monofilament, combinations thereof, etc.). In one particular exemplary embodiment, a geotextile fabric includes only polypropylene monofilament. Alternative embodiments may include a woven geotextile fabric that includes other types of monofilament yarns, fibers, threads, and/or other yarn types such as tape yarns and/or fibrillated tapes, etc.

In exemplary embodiments of a woven geotextile fabric, the yarns have a high denier, such as within a range from 1100 to 5000 denier, 1100 to 2500 denier, etc. In exemplary embodiments, the woven geotextile fabric includes monofilaments, tape yarns, and/or fibrillated tapes having a denier of at least 1100 (e.g., 1100, 1200, 1300, 1400, 1500, 1600, 1700, 1800, 1900, 2000, etc.). The warp and weft yarns may have the same denier, or they may have deniers different from each other. For example, the warp yarns may comprise 1100 denier yarns, and the weft yarns may comprise 1800 denier yarns. As another example, the warp yarns may comprise 1300 denier yarns, and the weft yarns may comprise 1900 denier yarns. In yet another example, the warp yarns may comprise 1600 denier yarns, and the weft yarns may comprise 2000 denier yarns.

In exemplary embodiments, the warp yarns have cross-sectional shapes or geometries different than the cross-sectional shapes or geometries of the weft yarns. In one particular embodiment, the weft yarns have a round, substantially circular cross-sectional shape, whereas the warp yarns have an oval cross-sectional shape with a width greater than its thickness or height. In this example, the round weft yarns may have an average diameter of 22 mils. Also in this example, the oval shape of the warp yarns may have a width of 34 mils with a maximum thickness at the center of 7.5 mils, which is the thickest point. Alternative embodiments may include a woven geotextile fabric having warp and/or weft yarns with other or additional cross-sectional shapes, geometries, and/or sizes. For example, the warp and weft yarns may both have a round, substantially circular cross-sectional shape. Or, for example, the warp and weft yarns may both have an oval cross-sectional shape. As yet another example, the warp yarns may have a round, substantially circular cross-sectional shape, and the weft yarns may have an oval cross-sectional shape with a width greater than its thickness or height.

In exemplary embodiments, the woven geotextile fabric may consist of a single warp set or system and a single weft set or system. In this example, the first or warp system and the second or weft system may each be comprised of high denier polypropylene monofilament. The first and second (or warp and weft) sets of monofilaments may be interwoven together (e.g., twill weave, etc.) to form a dimensionally stable network, which allows the yarns to maintain their relative position. By way of example only, the weft system may comprise polypropylene monofilament yarn having a rounded or substantially circular cross-sectional shape. The warp system may comprise polypropylene monofilament yarn having an oval cross-sectional shape.

Figure 2:
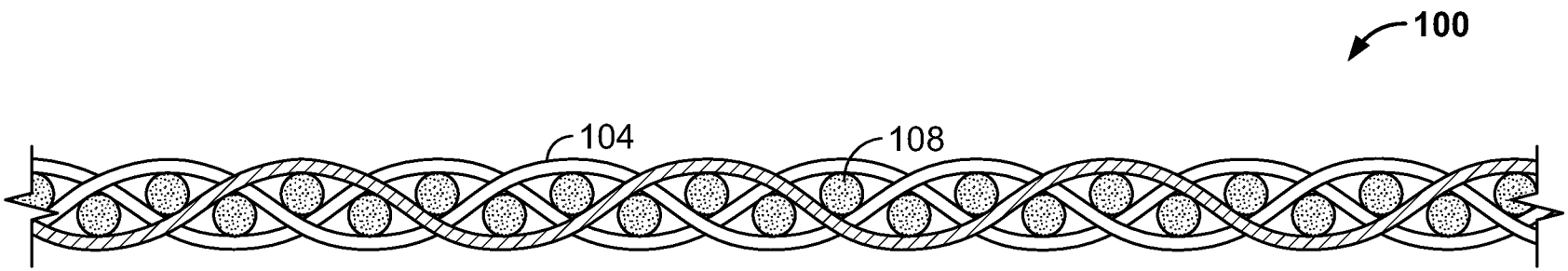
FIG. 2 is a cross-sectional side view of the woven geotextile fabric shown in FIG. 1, and illustrating the substantially rounded or circular cross-sectional shape of the weft yarns according to this exemplary embodiment.
Figure 3:
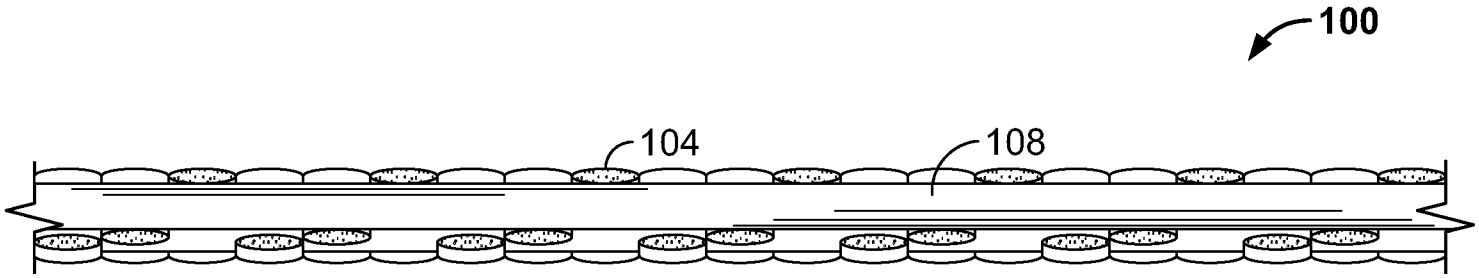
FIG. 3 is another cross-sectional side view of the woven geotextile fabric shown in FIG. 1, and illustrating the substantially oval cross-sectional shape of the warp yarns according to this exemplary embodiment.

With reference now to the figures, FIGS. 1, 2, and 3 illustrate an exemplary embodiment of a woven geotextile fabric 100 embodying one or more aspects of the present disclosure. As shown in FIG. 1, the woven geotextile fabric 100 includes warp and weft yarns, threads, or fibers 104, 108, respectively. The fabric 100 is configured to allow water to pass through open channels through the fabric 100 at a high rate, such as a water flow rate of at least 125 gallons per minute per square foot (gpm/ft$^2$), within a range from 125 gpm/ft$^2$ to 300 gpm/ft$^2$, etc.

In exemplary embodiments, the warp yarns 104 cross over and then under three weft yarns 108. The fabric 100 may have a 3/3 twill weave. In other exemplary embodiments, the warp yarns 104 may cross over and then under more or less than three (e.g., 1, 4, etc.) weft yarns 108. In additional exemplary embodiments, the fabric 100 may a basket weave (e.g., 2/2 basket weave, 2/1 basket weave, 3/1 basket weave, 3/3 basket weave, 4/4 basket weave, etc.), a sateen weave, or a plain weave. The warp and weft systems may comprise polypropylene monofilament having a high denier, e.g., within a range from 1100 to 5000 denier, within a range from 1100 to 2500 denier, etc.

As shown in FIGS. 2 and 3, the warp yarns 104 have cross-sectional shapes or geometries different than the cross-sectional shapes or geometries of the weft yarns 108. In this illustrated embodiment, the warp yarns 104 have an oval cross-sectional shape with a width greater than its thickness or height, whereas the weft yarns 108 have a round or circular cross-sectional shape. By way of example only, the round weft yarns 108 may have an average diameter of 22 mils. The oval shape of the warp yarns 104 may have a width of 34 mils with a maximum thickness at the center of 7.5 mils, which is the thickest point. Alternative embodiments may include a differently configured geotextile fabric, e.g., having different warp and/or weft yarns (e.g., having rectangular cross-sectional shapes, etc.), different weave patterns, etc. For example, the warp and weft yarns 104, 108 may both have a round, substantially circular cross-sectional shape. Or, for example, the warp and weft yarns 104, 108 may both have an oval cross-sectional shape. As yet another example, the warp yarns 104 may have a round, substantially circular cross-sectional shape, and the weft yarns 108 may have an oval cross-sectional shape with a width greater than its thickness or height.

Figure 4:
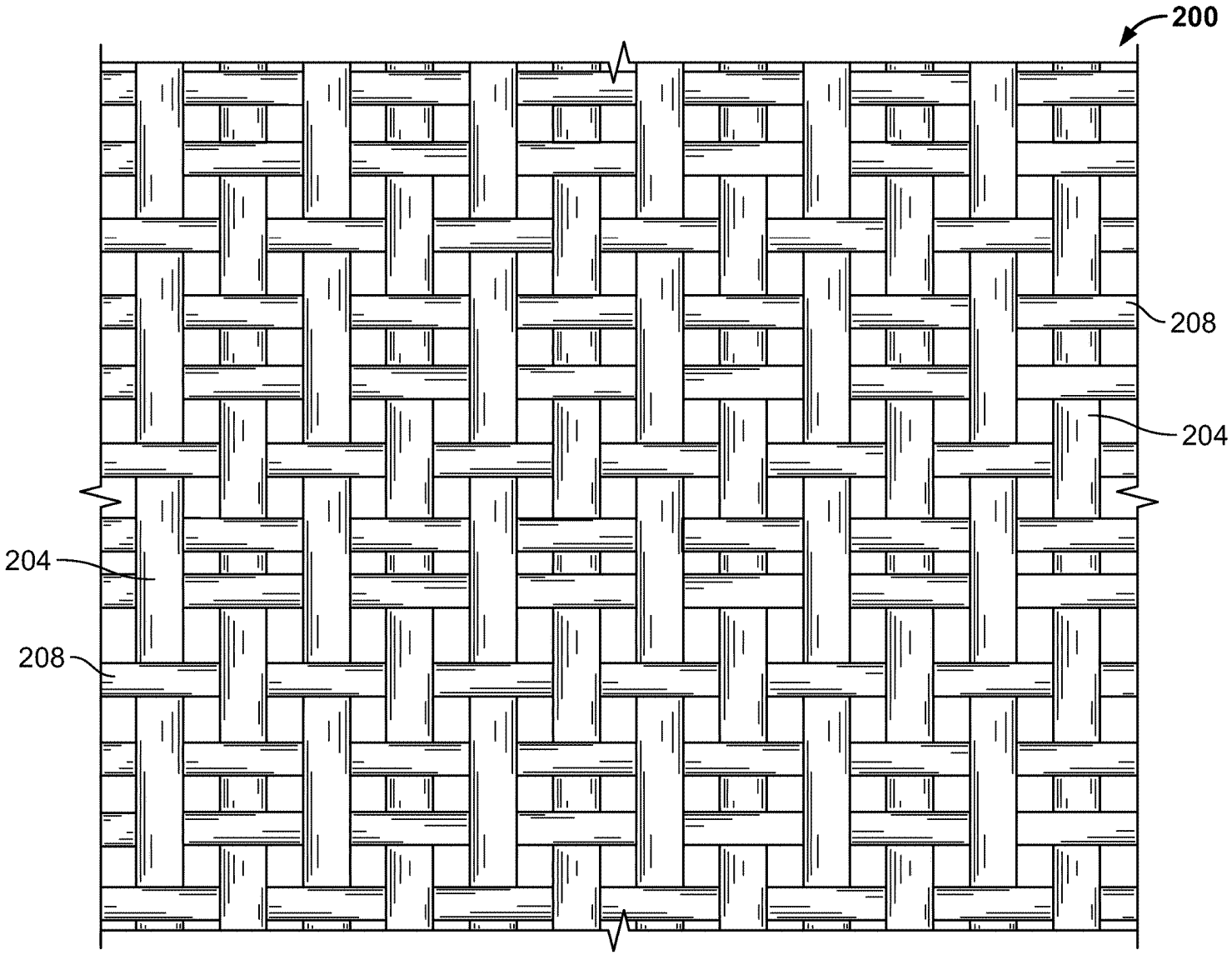
FIG. 4 is a top view of a woven geotextile fabric having a 2/1 basket weave according to another exemplary embodiment.
Figure 5:
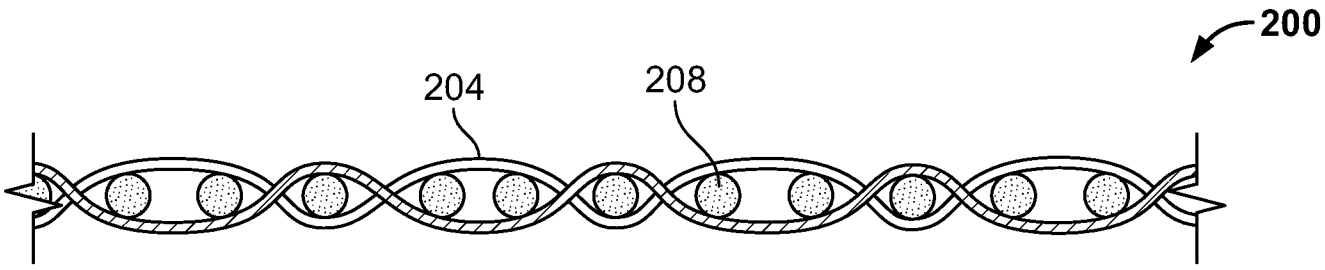
FIG. 5 is a cross-sectional side view of the woven geotextile fabric shown in FIG. 4, and illustrating the substantially rounded or circular cross-sectional shape of the weft yarns according to this exemplary embodiment.
Figure 6:
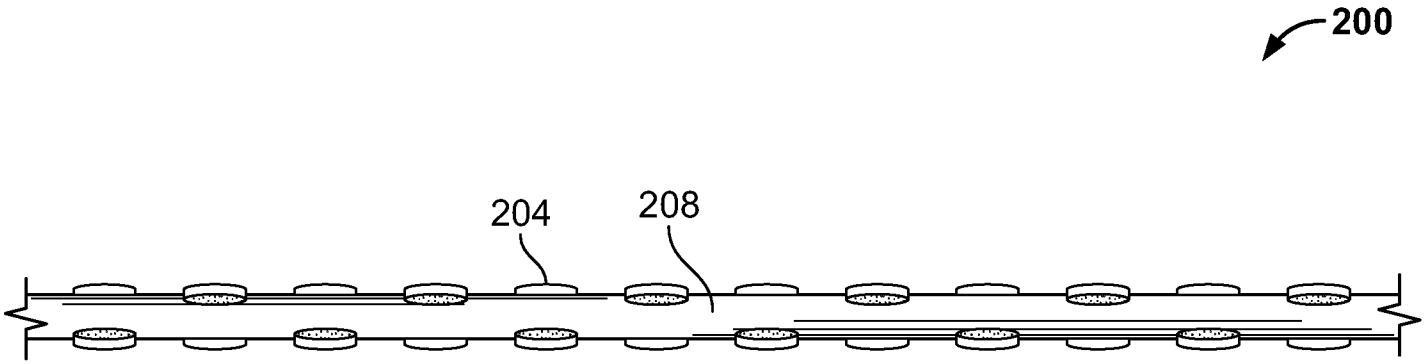
FIG. 6 is another cross-sectional side view of the woven geotextile fabric shown in FIG. 4, and illustrating the substantially oval cross-sectional shape of the warp yarns according to this exemplary embodiment.

FIGS. 4, 5, and 6 illustrate an exemplary embodiment of a woven geotextile fabric 200 embodying one or more aspects of the present disclosure. As shown in FIG. 4, the woven geotextile fabric 200 includes warp and weft yarns, threads, or fibers 204, 208, respectively. The fabric 200 is configured to allow water to pass through open channels through the fabric 200 at a high rate, such as a water flow rate of at least 125 gallons per minute per square foot (gpm/ft$^2$), within a range from 125 gpm/ft$^2$ to 300 gpm/ft$^2$, etc.

In this exemplary embodiment, the fabric 200 has a 2/1 basket weave. In additional exemplary embodiments, the fabric 100 may a different basket weave (e.g., 2/2 basket weave, 3/1 basket weave, 3/3 basket weave, 4/4 basket weave, etc.), a twill weave (e.g., 3/3 twill weave, 2/2 twill weave, etc.), a sateen weave, or a plain weave. The warp and weft systems may comprise polypropylene monofilament having a high denier, e.g., within a range from 1100 to 5000 denier, within a range from 1100 to 2500 denier, etc.

As shown in FIGS. 5 and 6, the warp yarns 204 have cross-sectional shapes or geometries different than the cross-sectional shapes or geometries of the weft yarns 208. In this illustrated embodiment, the warp yarns 204 have an oval cross-sectional shape with a width greater than its thickness or height, whereas the weft yarns 208 have a round or circular cross-sectional shape. By way of example only, the round weft yarns 208 may have an average diameter of 22 mils. The oval shape of the warp yarns 204 may have a width of 34 mils with a maximum thickness at the center of 7.5 mils, which is the thickest point. Alternative embodiments may include a differently configured geotextile fabric, e.g., having different warp and/or weft yarns (e.g., having rectangular cross-sectional shapes, etc.), different weave patterns, etc. For example, the warp and weft yarns 204, 208 may both have a round, substantially circular cross-sectional shape. Or, for example, the warp and weft yarns 204, 208 may both have an oval cross-sectional shape. As yet another example, the warp yarns 204 may have a round, substantially circular cross-sectional shape, and the weft yarns 208 may have an oval cross-sectional shape with a width greater than its thickness or height.

Figure 7:
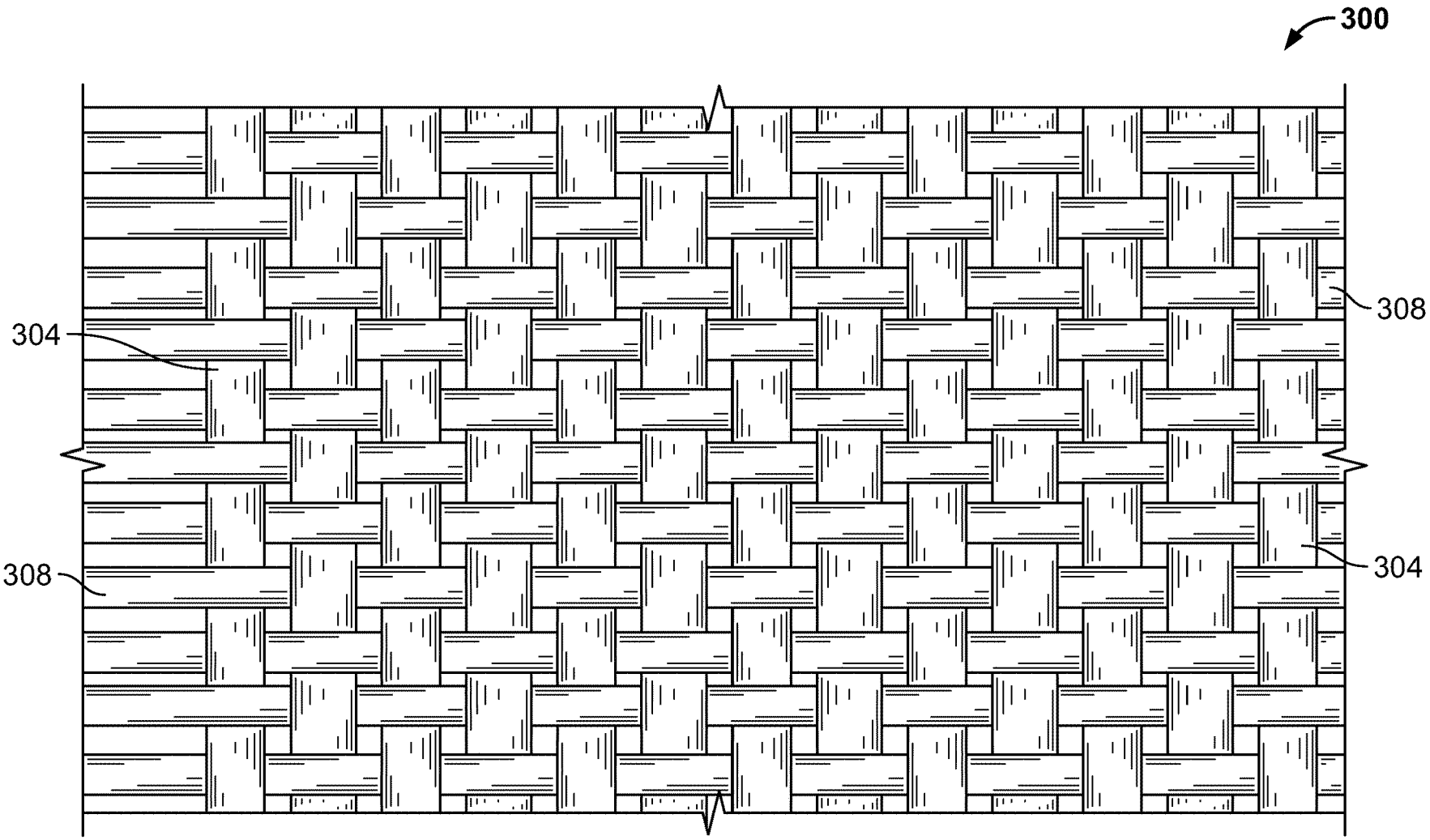
FIG. 7 is a top view of a woven geotextile fabric having a plain weave according to a further exemplary embodiment.
Figure 8:
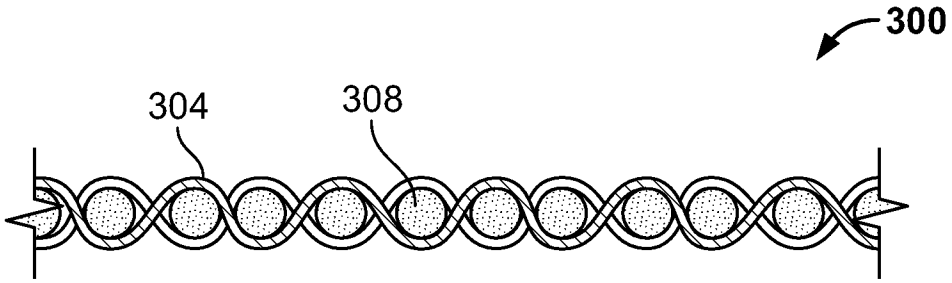
FIG. 8 is a cross-sectional side view of the woven geotextile fabric shown in FIG. 7, and illustrating the substantially rounded or circular cross-sectional shape of the weft yarns according to this exemplary embodiment.
Figure 9:
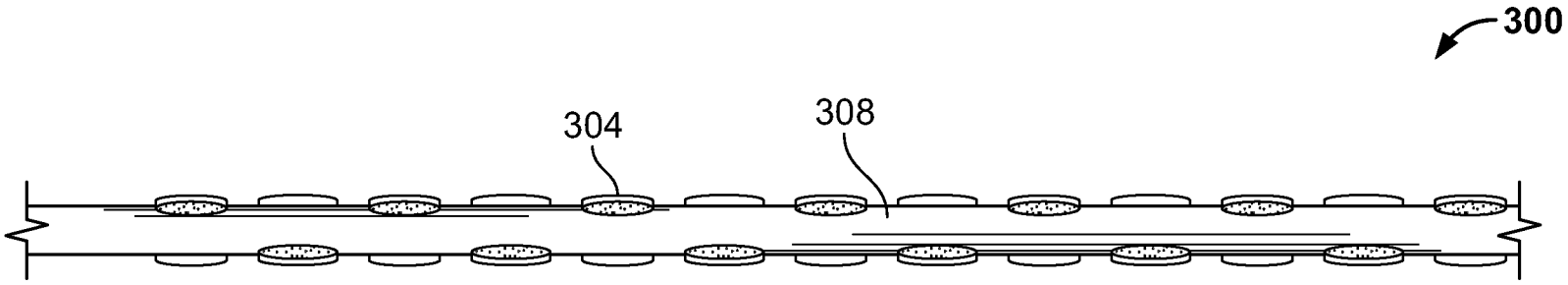
FIG. 9 is another cross-sectional side view of the woven geotextile fabric shown in FIG. 7, and illustrating the substantially oval cross-sectional shape of the warp yarns according to this exemplary embodiment.

FIGS. 7, 8, and 9 illustrate an exemplary embodiment of a woven geotextile fabric 300 embodying one or more aspects of the present disclosure. As shown in FIG. 7, the woven geotextile fabric 300 includes warp and weft yarns, threads, or fibers 304, 308, respectively. The fabric 300 is configured to allow water to pass through open channels through the fabric 300 at a high rate, such as a water flow rate of at least 125 gallons per minute per square foot (gpm/ft$^2$), within a range from 125 gpm/ft$^2$ to 300 gpm/ft$^2$, etc.

In this exemplary embodiment, the fabric 300 has a plain weave. In additional exemplary embodiments, the fabric 100 may a basket weave (e.g., 2/2 basket weave, 2/1 basket weave, 3/1 basket weave, 3/3 basket weave, 4/4 basket weave, etc.), a twill weave (e.g., 3/3 twill weave, 2/2 twill weave, etc.), a sateen weave, or a plain weave. The warp and weft systems may comprise polypropylene monofilament having a high denier, e.g., within a range from 1100 to 5000 denier, within a range from 1100 to 2500 denier, etc.

As shown in FIGS. 8 and 9, the warp yarns 304 have cross-sectional shapes or geometries different than the cross-sectional shapes or geometries of the weft yarns 308. In this illustrated embodiment, the warp yarns 304 have an oval cross-sectional shape with a width greater than its thickness or height, whereas the weft yarns 308 have a round or circular cross-sectional shape. By way of example only, the round weft yarns 308 may have an average diameter of 22 mils. The oval shape of the warp yarns 304 may have a width of 34 mils with a maximum thickness at the center of 7.5 mils, which is the thickest point. Alternative embodiments may include a differently configured geotextile fabric, e.g., having different warp and/or weft yarns (e.g., having rectangular cross-sectional shapes, etc.), different weave patterns, etc. For example, the warp and weft yarns 304, 308 may both have a round, substantially circular cross-sectional shape. Or, for example, the warp and weft yarns 304, 308 may both have an oval cross-sectional shape. As yet another example, the warp yarns 304 may have a round, substantially circular cross-sectional shape, and the weft yarns 308 may have an oval cross-sectional shape with a width greater than its thickness or height.

Aspects of the present disclosure will be further illustrated by the following five examples of woven geotextile fabrics including warp and weft systems comprising high denier monofilament yarns, where the cross-sectional shapes of the warp yarns and weft yarns are different from one another. These examples (as are all examples provided herein) are merely illustrative, and do not limit this disclosure to the construction of these particular woven geotextile fabrics or the properties and characteristics thereof.

Example 1

In a first example, a woven geotextile fabric included a single warp system and a single weft system. The warp system was comprised of 1300 or 1500 denier polypropylene monofilament yarns. The weft system was comprised of 1800 denier polypropylene monofilament yarns. The weft and warp yarns were woven to form a dimensionally stable network, which allows the yarns to maintain their relative position. The weft yarns had a rounded or circular cross-sectional shape, whereas the warp yarns had an oval (or football) cross-sectional shape different than the weft yarns. Dimensionally, the round weft yarns had an average diameter of 22 mils. The oval shape of the warp yarns had a width of 34 mils with a maximum thickness at the center of 7.5 mils, which is the thickest point. The fabric had a density of 27.5 threads per inch in the warp direction and a density of 20 threads per inch in the weft or fill direction. The fabric had a 2/2 twill weave pattern in which weft yarns are interwoven with and substantially perpendicular to the warp yarns.

The first example of a woven geotextile fabric had a water flow rate of at least 80 gallons per minute per square foot (gpm/ft$^2$) (e.g., at least at least 125 gpm/ft$^2$, etc.) as measured per ASTM standard D-4491. The first example had a tensile modulus at 2% strain cross direction of at least 30,000 pounds per foot (lbs/ft) as measured per ASTM standard D-4595, and an Apparent Opening Size (AOS) of 0.425 millimeter (mm) or less as measured per ASTM standard D-4751. The first example also had a permittivity of at least 1.09 sec$^{-1}$ at a water flow rate of at least 80 gpm/ft$^2$ (e.g., at least 1.67 sec$^{-1}$ at a water flow rate of at least 125 gpm/ft$^2$, etc.) as measured per ASTM standard D-4491. Additionally, the first sample had an ultraviolet (UV) resistance (500 hours) of at least 80% as measured per ASTM D-4355 standard.

Example 2

In a second example, a woven geotextile fabric included a single warp system and a single weft system. The warp system was comprised of 1300 or 1600 denier polypropylene monofilament yarns. The weft system was comprised of 1900 denier polypropylene monofilament yarns. The weft and warp yarns were woven to form a dimensionally stable network, which allows the yarns to maintain their relative position. The weft yarns had a rounded or circular cross-sectional shape, whereas the warp yarns had an oval cross-sectional shape different than the weft yarns. The fabric had a density of 27.5 threads per inch in the warp direction and a density of 21 threads per inch in the weft or fill direction. The fabric had a 2/2 twill weave pattern in which weft yarns are interwoven with and substantially perpendicular to the warp yarns.

The second example of a woven geotextile fabric had a water flow rate of at least 80 gpm/ft$^2$ (e.g., at least at least 125 gpm/ft$^2$, etc.) as measured per ASTM standard D-4491. The second example had a tensile modulus at 2% strain cross direction of at least 51,000 lbs/ft as measured per ASTM standard D-4595 and an Apparent Opening Size (AOS) of 0.425 mm or less as measured per ASTM standard D-4751. The second example also had a permittivity of at least 1.09 sec$^{-1}$ at a water flow rate of at least 80 gpm/ft$^2$ (e.g., at least 1.67 sec$^{-1}$ at a water flow rate of at least 125 gpm/ft$^2$, etc.) as measured per ASTM standard D-4491. Additionally, the second sample had an ultraviolet (UV) resistance (500 hour) of at least 80% as measured per ASTM D-4355 standard.

Example 3

In a third example, a woven geotextile fabric included a single warp system and a single weft system. The warp system was comprised of 1300 or 1600 denier polypropylene monofilament yarns. The weft system was comprised of 2000 denier polypropylene monofilament yarns. The weft and warp yarns were woven to form a dimensionally stable network, which allows the yarns to maintain their relative position. The weft yarns had a rounded or circular cross-sectional shape, whereas the warp yarns had an oval cross-sectional shape different than the weft yarns. The fabric had a density of 27.5 threads per inch in the warp direction and a density of 21 threads per inch in the weft or fill direction.

The fabric had a 2/2 twill weave pattern in which weft yarns are interwoven with and substantially perpendicular to the warp yarns.

The third example of a woven geotextile fabric had a water flow rate of at least 125 gpm/ft$^2$ as measured per ASTM standard D-4491. The third example had a tensile modulus at 2% strain cross direction of at least 55,000 lbs/ft as measured per ASTM standard D-4595 and an Apparent Opening Size (AOS) of 0.425 mm or less as measured per ASTM standard D-4751. The third example also had a permittivity of at least 1.67 sec$^{-1}$ at a water flow rate of at least 125 gpm/ft$^2$ as measured per ASTM standard D-4491. Additionally, the third example has an ultraviolet (UV) resistance (500 hours) of at least 80% as measured per ASTM D-4355 standard.

Example 4

In a fourth example, a woven geotextile fabric included a single warp system and a single weft system. The warp system was comprised of 1300 or 1600 denier polypropylene monofilament yarns. The weft system was comprised of 2000 denier polypropylene monofilament yarns. The weft and warp yarns were woven to form a dimensionally stable network, which allows the yarns to maintain their relative position. The weft yarns had a rounded or circular cross-sectional shape, whereas the warp yarns had an oval cross-sectional shape different than the weft yarns. The fabric had a density of 27.5 threads per inch in the warp direction and a density of 28.5 threads per inch in the weft or fill direction. The fabric had a 3/3 twill weave pattern in which weft yarns are interwoven with and substantially perpendicular to the warp yarns.

The fourth example of a woven geotextile fabric had a water flow rate of at least 80 gpm/ft$^2$ (e.g., at least at least 125 gpm/ft$^2$, etc.) as measured per ASTM standard D-4491. The fourth example had a tensile modulus at 2% strain cross direction of at least 90,000 lbs/ft as measured per ASTM standard D-4595 and an Apparent Opening Size (AOS) of 0.425 mm or less as measured per ASTM standard D-4751. The fourth example also had a permittivity of at least 1.09 sec$^{-1}$ at a water flow rate of at least 80 gpm/ft$^2$ (e.g., at least 1.67 sec$^{-1}$ at a water flow rate of at least 125 gpm/ft$^2$, etc.) as measured per ASTM standard D-4491. Additionally, the fourth example had an ultraviolet (UV) resistance (500 hours) of at least 80% as measured per ASTM D-4355 standard.

Example 5

In a fifth example, a woven geotextile fabric included a single warp system and a single weft system. The warp system was comprised of 1300 or 1600 denier polypropylene monofilament yarns. The weft system was comprised of 2000 denier polypropylene monofilament yarns. The weft and warp yarns were woven to form a dimensionally stable network, which allows the yarns to maintain their relative position. The weft yarns had a rounded or circular cross-sectional shape, whereas the warp yarns had an oval cross-sectional shape different than the weft yarns. The fabric had a density of 27.5 threads per inch in the warp direction and a density of 30 threads per inch in the weft or fill direction. The fabric had a 3/3 twill weave pattern in which weft yarns are interwoven with and substantially perpendicular to the warp yarns.

The fifth example of a woven geotextile fabric had a water flow rate of at least 125 gpm/ft$^2$ as measured per ASTM standard D-4491. The fifth example had a tensile modulus at 2% strain cross direction of at least 115,000 lbs/ft as measured per ASTM standard D-4595 and an Apparent Opening Size (AOS) of 0.425 mm or less as measured per ASTM standard D-4751. The fifth example also had a permittivity of at least 1.67 sec$^{-1}$ at a water flow rate of at least 125 gpm/ft$^2$ as measured per ASTM standard D-4491. Additionally, the fifth example had an ultraviolet (UV) resistance (500 hours) of at least 80% or more as measured per ASTM D-4355 standard.

Example 6

In a sixth example, a woven geotextile fabric included a single warp system and a single weft system. The warp system was comprised of 1100 to 1600 denier polypropylene monofilament yarns. The weft system was comprised of 1700 to 2000 denier polypropylene monofilament yarns. The weft and warp yarns were woven to form a dimensionally stable network, which allows the yarns to maintain their relative position. The weft yarns had a rounded or circular cross-sectional shape, whereas the warp yarns had an oval (or football) cross-sectional shape different than the weft yarns. Dimensionally, the round weft yarns had an average diameter of 22 mils. The oval shape of the warp yarns had a width of 34 mils with a maximum thickness at the center of 7.5 mils, which is the thickest point. The fabric had a density of 32 threads per inch in the warp direction and a density of 17 threads per inch in the weft or fill direction. The fabric had a 2/1 basket weave pattern in which weft yarns are interwoven with and substantially perpendicular to the warp yarns.

The sixth example of a woven geotextile fabric had a water flow rate of at least 125 gallons per minute per square foot (gpm/ft$^2$) as measured per ASTM standard D-4491. The sixth example had a tensile modulus at 2% strain cross direction of at least 51,000 pounds per foot (lbs/ft) as measured per ASTM standard D-4595, tensile strength at 2% strain machine direction of at least 600 pounds per foot with cross machine direction of at least 1000 pounds per foot as measured per ASTM standard D-4595, tensile strength at 5% strain machine direction of at least 1700 pounds per foot with cross machine direction of at least 2200 pounds per foot as measured per ASTM standard D-4595, and an Apparent Opening Size (AOS) of 0.425 millimeter (mm) or less as measured per ASTM standard D-4751. The sixth example also had a permittivity of at least 1.67 sec$^{-1}$ at a water flow rate of at least 125 gpm/ft$^2$ as measured per ASTM standard D-4491. Additionally, the sixth example had an ultraviolet (UV) resistance (500 hours) of at least 80% as measured per ASTM D-4355 standard.

Example 7

In a seventh example, a woven geotextile fabric included a single warp system and a single weft system. The warp system was comprised of 1100 to 1600 denier polypropylene monofilament yarns. The weft system was comprised of 1700 to 2000 denier polypropylene monofilament yarns. The weft and warp yarns were woven to form a dimensionally stable network, which allows the yarns to maintain their relative position. The weft yarns had a rounded or circular cross-sectional shape, whereas the warp yarns had an oval cross-sectional shape different than the weft yarns. The fabric had a density of 27.5 threads per inch in the warp direction and a density of 21 threads per inch in the weft or fill direction. The fabric had a 2/2 twill weave pattern in which weft yarns are interwoven with and substantially perpendicular to the warp yarns.

The seventh example of a woven geotextile fabric had a water flow rate of at least 125 gpm/ft$^2$ as measured per ASTM standard D-4491. The seventh example had a tensile modulus at 2% strain cross direction of at least 51,000 lbs/ft as measured per ASTM standard D-4595 and an Apparent Opening Size (AOS) of 0.425 mm or less as measured per ASTM standard D-4751. The seventh example also had a permittivity of at least 1.67 sec$^{-1}$ at a water flow rate of at least 125 gpm/ft$^2$ as measured per ASTM standard D-4491. Additionally, the seventh example had an ultraviolet (UV) resistance (500 hour) of at least 80% as measured per ASTM D-4355 standard.

Example 8

In an eighth example, a woven geotextile fabric included a single warp system and a single weft system. The warp system was comprised of 1100 to 1600 denier polypropylene monofilament yarns. The weft system was comprised of 1700 to 2000 denier polypropylene monofilament yarns. The weft and warp yarns were woven to form a dimensionally stable network, which allows the yarns to maintain their relative position. The weft yarns had a rounded or circular cross-sectional shape, whereas the warp yarns had an oval (or football) cross-sectional shape different than the weft yarns. Dimensionally, the round weft yarns had an average diameter of 22 mils. The oval shape of the warp yarns had a width of 34 mils with a maximum thickness at the center of 7.5 mils, which is the thickest point. The fabric had a density of 32 threads per inch in the warp direction and a density of 14 threads per inch in the weft or fill direction. The fabric had a plain weave pattern in which weft yarns are interwoven with and substantially perpendicular to the warp yarns.

The eighth example of a woven geotextile fabric had a water flow rate of at least 125 gpm/ft$^2$ as measured per ASTM standard D-4491. The eighth example had a tensile modulus at 2% strain cross direction of at least 30,000 pounds per foot (lbs/ft) as measured per ASTM standard D-4595, tensile strength at 2% strain machine direction of at least 600 pounds per foot with cross machine direction of at least 600 pounds per foot as measured per ASTM standard D-4595, tensile strength at 5% strain machine direction of at least 1600 pounds per foot with cross machine direction of at least 1600 pounds per foot as measured per ASTM standard D-4595, and an Apparent Opening Size (AOS) of 0.425 millimeter (mm) or less as measured per ASTM standard D-4751. The eighth example also had a permittivity of at least 1.67 sec$^{-1}$ at a water flow rate of at least 125 gpm/ft$^2$ as measured per ASTM standard D-4491. Additionally, the eighth example had an ultraviolet (UV) resistance (500 hours) of at least 80% as measured per ASTM D-4355 standard.

Example 9

In a ninth example, a woven geotextile fabric included a single warp system and a single weft system. The warp system was comprised of 1100 to 1600 denier polypropylene monofilament yarns. The weft system was comprised of 1700 to 2000 denier polypropylene monofilament yarns. The weft and warp yarns were woven to form a dimensionally stable network, which allows the yarns to maintain their relative position. The weft yarns had a rounded or circular cross-sectional shape, whereas the warp yarns had an oval cross-sectional shape different than the weft yarns. The fabric had a density of 32 threads per inch in the warp direction and a density of 32 threads per inch in the weft or fill direction. The fabric had a 3/3 twill weave pattern in which weft yarns are interwoven with and substantially perpendicular to the warp yarns.

The ninth example of a woven geotextile fabric had a water flow rate of at least 125 gpm/ft$^2$ as measured per ASTM standard D-4491. The ninth example had a tensile modulus at 2% strain cross direction of at least 90,000 lbs/ft as measured per ASTM standard D-4595, tensile strength at 2% strain machine direction of at least 500 pounds per foot with cross machine direction of at least 1800 pounds per foot as measured per ASTM standard D-4595, tensile strength at 5% strain machine direction of at least 1400 pounds per foot with cross machine direction of at least 4300 pounds per foot as measured per ASTM standard D-4595, and an Apparent Opening Size (AOS) of 0.425 mm or less as measured per ASTM standard D-4751. The ninth example also had a permittivity of at least 1.67 sec$^{-1}$ at a water flow rate of at least 125 gpm/ft$^2$ as measured per ASTM standard D-4491. Additionally, the ninth example had an ultraviolet (UV) resistance (500 hours) of at least 80% as measured per ASTM D-4355 standard.

Advantageously, all of the above examples of woven geotextile fabrics had high water flow rates (e.g., at least 125 gallons per minute per square foot (gpm/ft$^2$), within a range from 125 gpm/ft$^2$ to 300 gpm/ft$^2$, etc.) while also having a relatively high tensile modulus at 2% strain cross direction of at least 30,000 lbs/ft and relatively small Apparent Opening Size (AOS) of 0.425 mm or less. The example geotextile fabrics also had good resistance to ultraviolet deterioration, rotting, and biological degradation, and were inert to commonly encountered soil chemicals. The example woven textile fabrics may have roll dimensions of 15 ft by 300 ft (or 4.6 m×91.5 m) and roll area of 500 yd$^2$ (or 418 m$^2$).

Exemplary embodiments of woven geotextile fabrics disclosed herein may be used in a wide range of applications. By way of example only, woven geotextile fabrics may be used to help support and extend the life of parking lots, paved and unpaved roadways, loading docks, etc. by providing separation and/or stabilization of the different components of the structure. The fabric gives the project a permeable separation and/or stabilization layer, keeps the aggregate and subsoils from mixing, allows water drainage, and enhances structural integrity of the subgrade while helping to reduce costs.

Exemplary embodiments disclosed herein may thus provide one or more (but not necessarily any or all) of the following advantages or benefits. For example, exemplary embodiments may have superior or exceptional tensile modulus at 2% strain cross direction (e.g., at least 30,000 pounds per foot, etc.), water flow properties (e.g., of at least 125 gallons per minute, etc.), and AOS (e.g., 0.425 mm or less, etc.). The woven geotextile fabrics disclosed herein may be used for stabilization, separation, filtration, reinforcement, confinement, and erosion control for a wide variety of site conditions from moderate to severe. For example, an exemplary embodiment of a woven geotextile fabric disclosed herein may help insure long term performance of transportation systems and consistent load distribution in construction application. Exemplary woven geotextile fabrics disclosed herein may provide high soil confinement for greater load distribution, may be durable, may have superior damage resistance, may have high modulus for immediate structural support, and/or may have a unique weave optimizing both strength and filtration properties.

Example embodiments are provided so that this disclosure will be thorough, and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms, and that neither should be construed to limit the scope of the disclosure. In some example embodiments, well-known processes, well-known device structures, and well-known technologies are not described in detail. In addition, advantages and improvements that may be achieved with one or more exemplary embodiments of the present disclosure are provided for purpose of illustration only and do not limit the scope of the present disclosure, as exemplary embodiments disclosed herein may provide all or none of the above mentioned advantages and improvements and still fall within the scope of the present disclosure.

Specific dimensions, specific materials, and/or specific shapes disclosed herein are example in nature and do not limit the scope of the present disclosure. The disclosure herein of particular values and particular ranges of values for given parameters are not exclusive of other values and ranges of values that may be useful in one or more of the examples disclosed herein. Moreover, it is envisioned that any two particular values for a specific parameter stated herein may define the endpoints of a range of values that may be suitable for the given parameter (i.e., the disclosure of a first value and a second value for a given parameter can be interpreted as disclosing that any value between the first and second values could also be employed for the given parameter). For example, if Parameter X is exemplified herein to have value A and also exemplified to have value Z, it is envisioned that parameter X may have a range of values from about A to about Z. Similarly, it is envisioned that disclosure of two or more ranges of values for a parameter (whether such ranges are nested, overlapping or distinct) subsume all possible combination of ranges for the value that might be claimed using endpoints of the disclosed ranges. For example, if parameter X is exemplified herein to have values in the range of 1-10, or 2-9, or 3-8, it is also envisioned that Parameter X may have other ranges of values including 1-9, 1-8, 1-3, 1-2, 2-10, 2-8, 2-3, 3-10, and 3-9.

The terminology used herein is for the purpose of describing particular example embodiments only and is not intended to be limiting. As used herein, the singular forms "a", "an" and "the" may be intended to include the plural forms as well, unless the context clearly indicates otherwise. The terms "comprises," "comprising," "including," and "having," are inclusive and therefore specify the presence of stated features, integers, steps, operations, elements, and/or components, but do not preclude the presence or addition of one or more other features, integers, steps, operations, elements, components, and/or groups thereof. The method steps, processes, and operations described herein are not to be construed as necessarily requiring their performance in the particular order discussed or illustrated, unless specifically identified as an order of performance. It is also to be understood that additional or alternative steps may be employed.

When an element or layer is referred to as being "on", "engaged to", "connected to" or "coupled to" another element or layer, it may be directly on, engaged, connected or coupled to the other element or layer, or intervening elements or layers may be present. In contrast, when an element is referred to as being "directly on," "directly engaged to", "directly connected to" or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

The term "about" when applied to values indicates that the calculation or the measurement allows some slight imprecision in the value (with some approach to exactness in the value; approximately or reasonably close to the value; nearly). If, for some reason, the imprecision provided by "about" is not otherwise understood in the art with this ordinary meaning, then "about" as used herein indicates at least variations that may arise from ordinary methods of measuring or using such parameters. For example, the terms "generally", "about", and "substantially" may be used herein to mean within manufacturing tolerances.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the example embodiments.

Spatially relative terms, such as "inner," "outer," "beneath", "below", "lower", "above", "upper" and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

The foregoing description of the embodiments has been provided for purposes of illustration and description. It is not intended to be exhaustive or to limit the disclosure. Individual elements, intended or stated uses, or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

What is claimed is:

1. A geotextile fabric comprising a single weft yarn system including weft yarns and a single warp yarn system including warp yarns that are interwoven with the weft yarns, wherein:

the geotextile fabric is configured to have a water flow rate of at least 125 gallons per minute per square foot;

the geotextile fabric is configured to have a tensile modulus at 2% strain cross direction of at least 30,000 pounds per foot;

an apparent opening size of no more than 0.425 millimeters;

the warp yarns have an oval cross-sectional shape;

the weft yarns have a round cross-sectional shape;

the warp yarns comprise 1100 to 1600 denier polypropylene monofilament yarns; and the weft yarns comprise 1700 to 2000 denier polypropylene monofilament yarns.

2. The geotextile fabric of claim 1, wherein the geotextile fabric is configured to have a machine direction tensile strength at 2% strain of at least 500 pounds per foot, a cross machine direction tensile strength at 2% strain of at least 600 pounds per foot, a machine direction tensile strength at 5% strain of at least 1600 pounds per foot, and a cross machine direction tensile strength of at least 1600 pounds per foot.

3. The geotextile fabric of claim 2, wherein:

the weft yarns are interwoven with the warp yarns such that the geotextile fabric has a 2/1 basket weave pattern; and/or the geotextile fabric has a density of 32 threads per inch in a warp direction and a density of 17 threads per inch in a weft direction.

4. The geotextile fabric of claim 3, wherein:

the geotextile fabric is configured to have a tensile modulus at 2% strain cross direction of at least 51,000 pounds; and/or the geotextile fabric is configured to have a machine direction tensile strength at 2% strain of at least 600 pounds per foot; and/or the geotextile fabric is configured to have a cross machine direction tensile strength at 2% strain of at least 1000 pounds per foot; and/or the geotextile fabric is configured to have a machine direction tensile strength at 5% strain of at least 1700 pounds per foot; and/or the geotextile fabric is configured to have a cross machine direction tensile strength of at least 2200 pounds per foot.

5. The geotextile fabric of claim 2, wherein:

the weft yarns are interwoven with the warp yarns such that the geotextile fabric has a 2/1 basket weave pattern;

the geotextile fabric has a density of 32 threads per inch in a warp direction and a density of 17 threads per inch in a weft direction;

the geotextile fabric is configured to have a tensile modulus at 2% strain cross direction of at least 51,000 pounds; and the geotextile fabric is configured to have a machine direction tensile strength at 2% strain of at least 600 pounds per foot; and the geotextile fabric is configured to have a cross machine direction tensile strength at 2% strain of at least 1000 pounds per foot; and the geotextile fabric is configured to have a machine direction tensile strength at 5% strain of at least 1700 pounds per foot; and the geotextile fabric is configured to have a cross machine direction tensile strength of at least 2200 pounds per foot; and the geotextile fabric is configured to have a permittivity of at least 1.65 $sec^{-1}$; and the geotextile fabric is configured to have an ultraviolet (UV) resistance (500 hours) of at least 80%.

6. The geotextile fabric of claim 2, wherein:

the weft yarns are interwoven with the warp yarns such that the geotextile fabric has a 2/2 twill weave pattern; and/or the geotextile fabric has a density of 27.5 threads per inch in a warp direction and a density of 21 threads per inch in a weft direction.

7. The geotextile fabric of claim 6, wherein the geotextile fabric is configured to have a tensile modulus at 2% strain cross direction of at least 51,000 pounds.

8. The geotextile fabric of claim 2, wherein:

the weft yarns are interwoven with the warp yarns such that the geotextile fabric has a 2/2 twill weave pattern; and the geotextile fabric has a density of 27.5 threads per inch in a warp direction and a density of 21 threads per inch in a weft direction; and the geotextile fabric is configured to have a tensile modulus at 2% strain cross direction of at least 51,000 pounds; and the geotextile fabric is configured to have a permittivity of at least 1.65 sec-1; and the geotextile fabric is configured to have an ultraviolet (UV) resistance (500 hours) of at least 80%.

9. The geotextile fabric of claim 2, wherein:

the weft yarns are interwoven with the warp yarns such that the geotextile fabric has a plain weave pattern; and/or the geotextile fabric has a density of 32 threads per inch in a warp direction and a density of 14 threads per inch in a weft direction.

10. The geotextile fabric of claim 9, wherein the geotextile fabric is configured to have a machine direction tensile strength at 2% strain of at least 600 pounds per foot.

11. The geotextile fabric of claim 2, wherein:

the weft yarns are interwoven with the warp yarns such that the geotextile fabric has a plain weave pattern; and the geotextile fabric has a density of 32 threads per inch in a warp direction and a density of 14 threads per inch in a weft direction; and the geotextile fabric is configured to have a machine direction tensile strength at 2% strain of at least 600 pounds per foot; and the geotextile fabric is configured to have a permittivity of at least 1.65 sec-1; and the geotextile fabric is configured to have an ultraviolet (UV) resistance (500 hours) of at least 80%.

12. The geotextile fabric of claim 2, wherein:

the weft yarns are interwoven with the warp yarns such that the geotextile fabric has a 3/3 twill weave pattern; and/or the geotextile fabric has a density of 32 threads per inch in a warp direction and a density of 32 threads per inch in a weft direction.

13. The geotextile fabric of claim 12, wherein:

the geotextile fabric is configured to have a tensile modulus at 2% strain cross direction of at least 90,000 pounds; and/or the geotextile fabric is configured to have a cross machine direction tensile strength at 2% strain of at least 1800 pounds per foot; and/or the geotextile fabric is configured to have a machine direction tensile strength at 5% strain of at least 1400 pounds per foot; and/or the geotextile fabric is configured to have a cross machine direction tensile strength of at least 4300 pounds per foot.

14. The geotextile fabric of claim 2, wherein:

the weft yarns are interwoven with the warp yarns such that the geotextile fabric has a 3/3 twill weave pattern; and the geotextile fabric has a density of 32 threads per inch in a warp direction and a density of 32 threads per inch in a weft direction; and the geotextile fabric is configured to have a tensile modulus at 2% strain cross direction of at least 90,000 pounds; and the geotextile fabric is configured to have a cross machine direction tensile strength at 2% strain of at least 1800 pounds per foot; and the geotextile fabric is configured to have a machine direction tensile strength at 5% strain of at least 1400 pounds per foot; and the geotextile fabric is configured to have a cross machine direction tensile strength of at least 4300 pounds per foot; and the geotextile fabric is configured to have a permittivity of at least 1.65 $sec^{-1}$; and the geotextile fabric is configured to have an ultraviolet (UV) resistance (500 hours) of at least 80%.

15. The geotextile fabric of claim 2, wherein:

the geotextile fabric is configured to have a permittivity of at least 1.65 sec-1; and/or the geotextile fabric is configured to have an ultraviolet (UV) resistance (500 hours) of at least 80%.

16. The geotextile fabric of claim 2, wherein the weft yarns are interwoven with the warp yarns such that the geotextile fabric has a basket weave, a twill weave, a sateen weave, or a plain weave.

17. The geotextile fabric of claim 1, wherein the geotextile fabric consists of the single warp yarn system and the single weft yarn system that includes the weft yarns.

18. The geotextile fabric of claim 1, wherein the geotextile fabric is configured to have a water flow rate within a range of 125 to 300 gallons per minute per square foot.

19. The geotextile fabric of claim 1, wherein the warp and weft yarns are interwoven to form a dimensionally stable network.

* * * * *